United States Patent [19]

Wilfert et al.

[11] 4,132,211

[45] Jan. 2, 1979

[54] FUEL INJECTION SYSTEM

[75] Inventors: Thomas Wilfert, Markgröningen; Alfred Grassle, Ludwigsburg; Klaus-Jürgen Peters, Affalterbach, all of Germany

[73] Assignee: Robert Bosch GmbH, Stuttgart, Germany

[21] Appl. No.: 732,127

[22] Filed: Oct. 13, 1976

[30] Foreign Application Priority Data

Oct. 24, 1975 [DE] Fed. Rep. of Germany ..... 2547645

[51] Int. Cl.[2] ..... F02N 17/00

[52] U.S. Cl. ..... 123/179 L; 123/139 ST; 261/50 A; 261/39 B

[58] Field of Search ..... 123/139 AW, 119 F, 179 L; 261/50 A, 50 AA, 39 B, 39 E

[56] References Cited

U.S. PATENT DOCUMENTS

| | | | |
|---|---|---|---|
| 3,613,650 | 10/1971 | Stampp et al. | 123/139 AW |
| 3,628,515 | 12/1971 | Knapp et al. | 123/139 AW |
| 3,730,155 | 5/1973 | Knapp | 261/39 E |
| 3,752,133 | 8/1973 | Irish et al. | 261/39 E |
| 3,806,854 | 4/1974 | Armstrong | 123/119 F |
| 3,999,527 | 12/1976 | Wessel et al. | 123/139 AW |
| 4,026,259 | 5/1977 | Meyerdierks et al. | 123/139 AW |

*Primary Examiner*—Charles J. Myhre
*Assistant Examiner*—David D. Reynolds
*Attorney, Agent, or Firm*—Edwin E. Greigg

[57] ABSTRACT

A fuel injection system for continuous injection to an internal combustion engine has a pivoting air sensor plate with a correction lever that engages a fuel control plunger for metering out fuel in proportion to the air flow. The system also includes a bimetallic, temperature-dependent strip which exerts an opening force on the correction lever when the engine is cold. An electric heater is energized by the starter switch and begins to reduce the force due to the bimetallic strip even before the engine has actually warmed up. A second electric heater of reduced power maintains the strip in disengagement during normal engine operation.

6 Claims, 3 Drawing Figures

FUEL INJECTION SYSTEM

BACKGROUND OF THE INVENTION

The invention relates to a fuel injection system for mixture compressing internal combustion engines which employ continuous fuel injection into the induction manifold. The induction manifold includes an air flow sensor and an arbitrarily settable throttle plate. The air flow sensor is displaced by the flowing air and is returned to its normal position by a restoring force and, during its motions, displaces the control plunger of a fuel metering and distributing system which apportions fuel to the air.

Fuel injection systems of this type have the purpose to provide automatically a favorable fuel-air mixture for all operational conditions of the engine so as to insure complete combustion and the highest power or least fuel consumption. At the same time, the generation of toxic exhaust gas constituents is intended to be sharply reduced. For these purposes, it is required that the fuel quantity be metered out very precisely.

In known fuel injection systems of this type, it is a design criterion to meter out the fuel as nearly as possible proportional to the air mass flowing through the induction tube and the ratio of air to fuel may be altered by changing the restoring force of the air flow sensor in dependence on certain operational variables of the engine and by means of at least one pressure control valve.

In order to insure proper starting of engines at temperatures lower than approximately 20° C., the known fuel injection systems are provided with a starting mechanism which includes mainly an electromagnetic starting valve which is energized together with the engine starter and which also has a thermal time switch which limits the opening time of the magnetic valve and completely inhibits it at certain higher temperatures. The electromagnetic starting valve injects the supplementary fuel into the common induction manifold. The thermal time switch opens and closes the electrical circuit of the valve in dependence on engine temperature. When engine starting takes place at a temperature less than +20° C., an electrically heated bimetallic spring eventually interrupts the electric circuit.

A cold starting mechanism of this type not only requires a considerable additional expense because of the presence of the additional electromagnetic valve and the thermal switch but, in addition, the injection of fuel into the common manifold produces rather poor fuel distribution with respect to the individual cylinders.

OBJECT AND SUMMARY OF THE INVENTION

It is a principal object of the invention to provide a fuel injection system of the generally known type which insures reliable cold starting of the engine with only very small additional constructional cost and without using the above-described cold starting mechanism.

This and other objects are attained according to the invention by providing a bimetallic spring which is so coupled to the control plunger of the metering and distribution valve assembly that, when engine starting takes place at temperatures lower than 20° C., the control plunger is displaced. The invention further provides that the bimetallic spring is heated by an electric heater whose circuit is opened and closed together with the ignition circuit of the engine and which heats the bimetallic spring so as to displace it out of engagement with the control plunger.

Thus, according to the invention, when engine starting takes place below 20° C., the presence of the bimetallic spring at the metering and distribution valve results in a fuel quantity which depends on the starting temperature and this fuel quantity is injected in the normal manner through the regular fuel injection valves of the engine in a location lying, in each case, directly ahead of the individual inlet valves of the cylinders.

This individual injection makes possible a much improved fuel distribution and uniformity with respect to the individual cylinders than would be possible when a single cold starting valve is used. It is another advantageous feature of the invention that the electric heating element begins to reduce the starting fuel quantity even when the cooling water temperature is still practically unchanged, because the cylinder walls already are sufficiently warmed up after very few cycles to prevent fuel condensation at the cylinder walls. Thus, the concentration of toxic exhaust gas components is reduced immediately after engine starting.

It is a favorable feature of the invention to provide a further electric heating element for the bimetallic spring, whose circuit is closed by the ignition switch of the engine and which provides somewhat less heating power than the primary heater element. Yet another feature of the invention is that the fixed end of the bimetallic spring is coupled to the air flow sensor while the free end of the bimetallic spring engages a correction lever of the air flow sensor which then actuates the control plunger of the fuel metering system. This arrangement permits a certain amount of post-start enrichment even after the engine is already operating which helps to insure a reliable running and fuel processing directly after starting.

In a second embodiment of the invention, the fixed end of the bimetallic spring is attached to the housing of the air flow sensor while the free end engages the pivotal arm of the air flow sensor.

Yet another embodiment of the invention provides that the bimetallic spring is a double lever which pivots about a point fixed in the housing. One of the levers is engaged by a starting solenoid while the other lever carries the primary electric heating element. This embodiment further provides that the electric circuit of the solenoid is actuated by the ignition and starter switch and that, when the solenoid is energized, the opposite lever of the bimetallic spring engages the pivotal arm of the air flow sensor and thus displaces the control plunger as a function of temperature so as to open the fuel metering and distribution valve.

A favorable embodiment of the electric heating element is a PTC resistor.

The invention will be better understood as well as further objects and advantages thereof become more apparent from the ensuing detailed description of two preferred embodiments taken in conjunction with the drawing.

DESCRIPTION OF THE PREFERRED EMBODIMENTS

Figure 1:
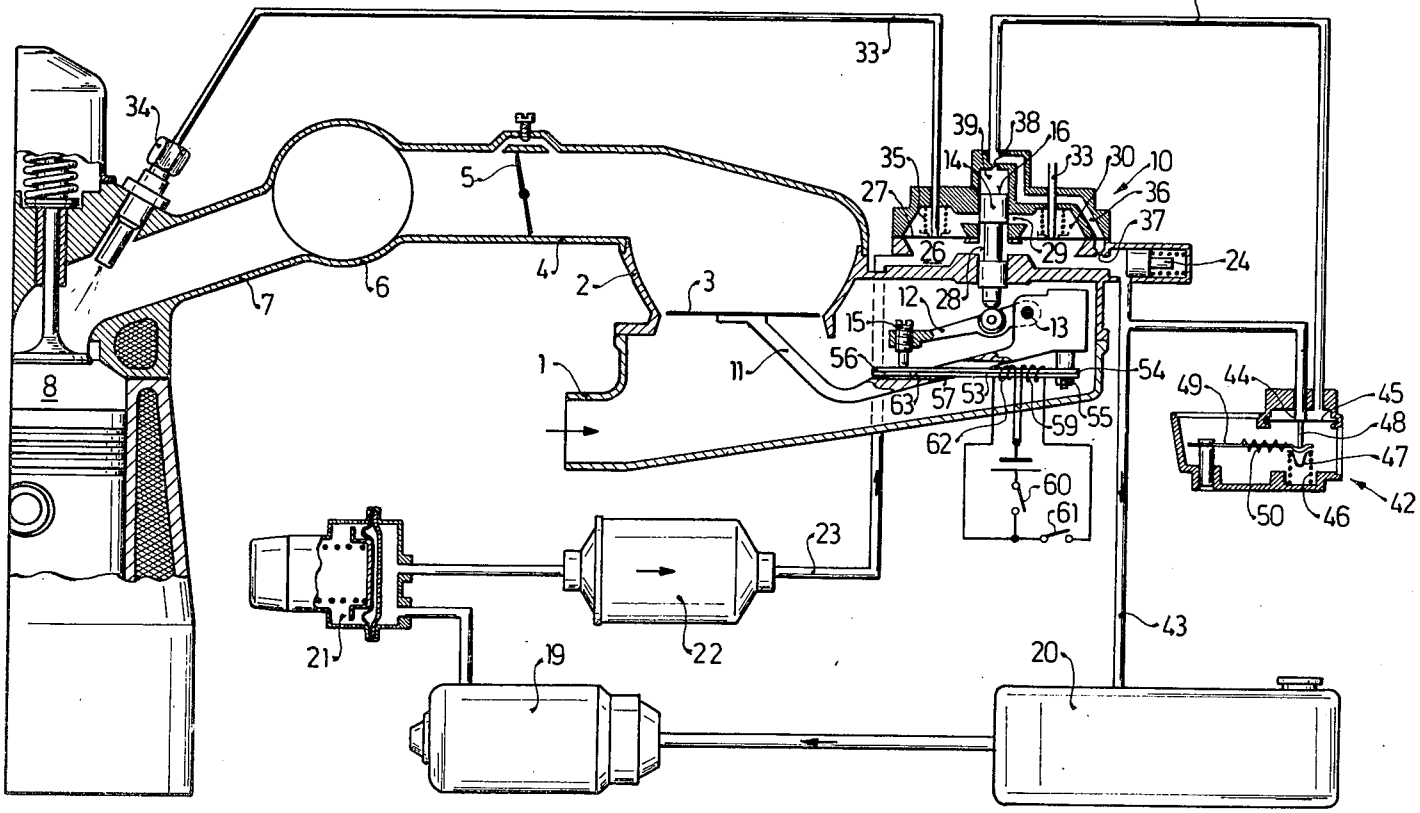
FIG. 1 is a diagram illustrating a first exemplary embodiment of the fuel injection system including cold starting control.

Turning now to FIG. 1, there is illustrated a first embodiment of the fuel injection system according to the invention including an induction manifold region 1 with a conical section 2 which includes an air flow sensor 3. A subsequent section 4 of the induction tube includes an arbitrarily actuated throttle plate 5 and a common induction manifold 6 which connects with individual induction pipes 7 leading to one or several cylinders 8 of an internal combustion engine. The air flow sensor 3, whose plane is perpendicular to the air flow, is displaced within the conical section 2 of the induction tube so as to obey an approximately linear function of the air flow rate through the induction tube. If the restoring force acting on the air flow sensor 3 is constant and if the air pressure prevailing upstream of the sensor 3 is also constant, then the pressure prevailing between the air sensor 3 and the throttle plate 5 remains constant as well. The air flow sensor acts to control a fuel metering and distributor valve 10. For the purpose of transmitting the motions of the air flow plate 3, it is connected with a pivoting arm 11 on which is mounted a correction lever 12 both of which pivot about an axis 13. During the pivotal motions of the throttle plate, a control plunger 14, which is the movable valve member of the fuel metering and distribution valve 10, is displaced. The desired fuel-air ratio may be further adjusted by a mixture control screw 15. The face 16 of the control plunger 14 is impinged by control fluid whose pressure provides the restoring force for the air flow sensor 3.

An electric fuel pump 19 supplies fuel from a reservoir 20 via a fuel storage volume 21, a fuel filter 22 and a fuel supply line 23 to the metering and distribution valve 10. A pressure regulator 24 maintains the primary fuel circuit pressure constant.

The fuel supply line 23 branches out to various chambers 26 of the fuel metering and distribution valve 10, thereby applying fuel pressure to one side of a diaphragm 27. The control plunger 14 has an annular recess which communicates with the pressure chambers 26. Depending on the axial position of the control plunger 14, the annular recess 28 provides access to metering slits 29, each of which leads to a chamber 30 that is separated from opposite chambers 26 by the diaphragm 27. From the chambers 30, the fuel flows through injection channels 33 to the individual injection valves 34, which are, in each case, located in the vicinity of an engine cylinder 8 within the induction tube section 7. The diaphragm 27 controls a flat-seat valve which also includes a spring 35 which maintains the valve open when the fuel injection system is inoperative. The pressure cells, formed by a chamber 26 and a chamber 30, maintain the pressure drop across the metering valve assembly 28, 29 substantially constant independently of the degree of overlap between the annular recess 28 and the metering slits 29, i.e., independently of the amount of fuel delivered to the injection valves 34. This insures that the displacement path of the control plunger 14 is proportional to the metered out fuel.

When the lever 11 pivots, the air flow sensor 3 is moved within the conical portion 2 and the annular flow cross section defined by the edge of the air flow sensor and the conical induction tube changes in magnitude approximately proportional to the displacement of the air flow sensor 3. The constant restoring force acting on the control plunger 14 is provided by pressurized fuel. For this purpose, a control pressure line 36 branches off from the main fuel supply line 23 and is decoupled therefrom by a throttle 37. The control pressure line 36 communicates through a damping throttle 38 with a pressure chamber 39 into which the face 16 of the control plunger 14 extends.

Figure 3:
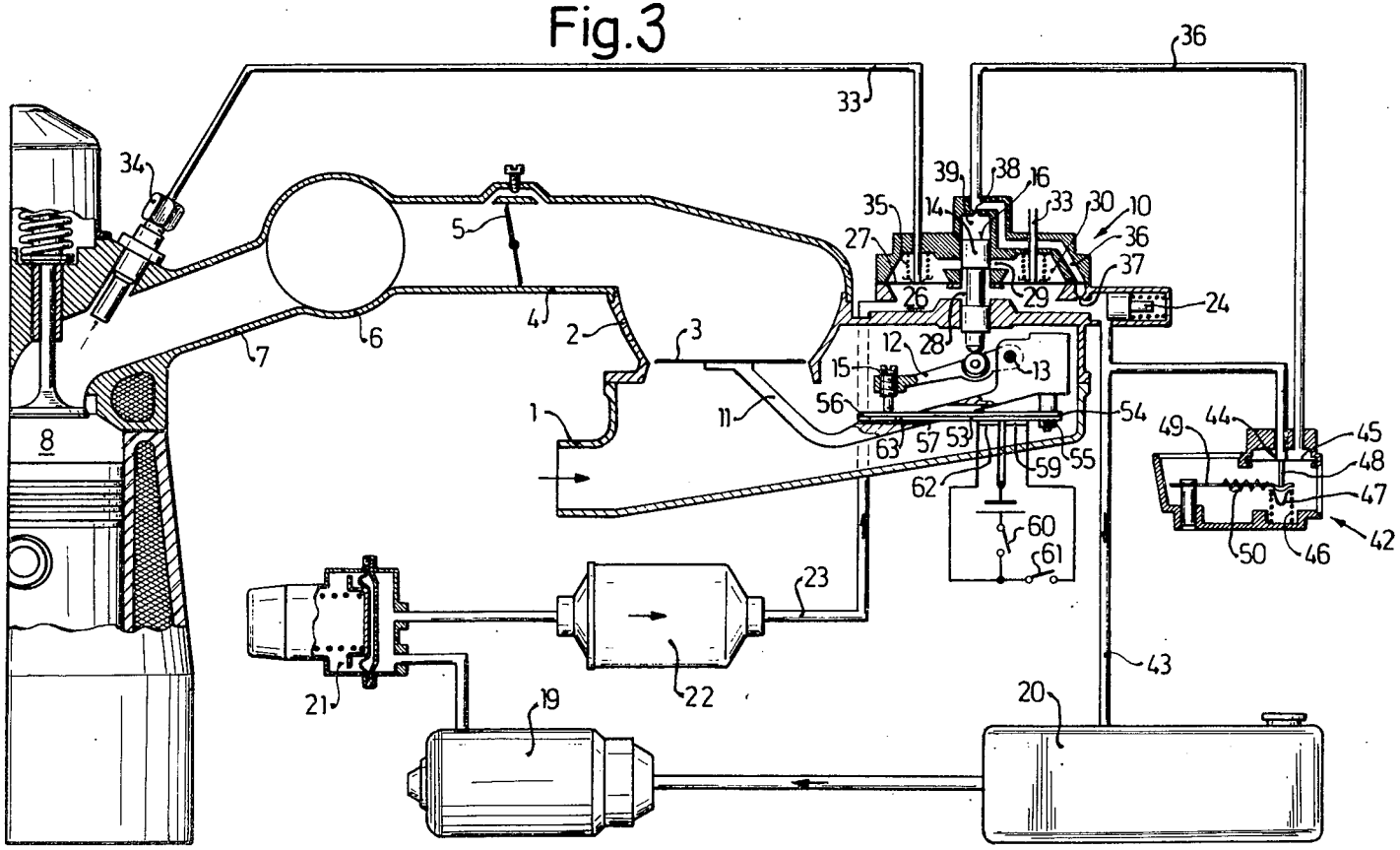
FIG. 3 is a variant of the first embodiment illustrated in FIG. 1 with PTC resistors as heater elements.

The control pressure line 36 includes a control pressure valve which permits the return of control fluid back to the fuel container 20 through a return line 43 at ambient pressure. The control pressure valve 42 permits changing the restoring force exerted by the control fluid during the warm-up period of the engine according to a predetermined function of time and temperature. The control pressure valve 42 is embodied as a flat seat valve having a fixed valve seat 44 and a diaphragm 45 which is urged in the closing direction of the valve by a spring 46. The spring 46 engages a spring support 47 which acts through a pin 48 onto the diaphragm 45. When the engine temperature is below its normal operating temperature, the force of the spring 46 opposes that of a bimetallic strip 49 on which is mounted an electric heating element 50. When the heating element 50 is energized, the heat it provides leads to a reduction of the force exerted by the bimetallic strip 49 onto the spring 46 after engine starting. In order to determine the fuel quantity during cold starting, i.e., when the starting temperatures are less than approximately 20° C., there is provided a second bimetallic spring 53 whose fixed end 54 is connected by a bolt 55 to the pivotal lever 11 of the air flow sensor 3. The free end 56 of the second bimetallic spring 53 passes through an opening 57 of the lever 11 and engages the mixture control screw 15 of the correction lever 12 which engages the control plunger 14 of the fuel metering and distribution valve 10. Thus, the bimetallic spring 53 shifts the position of the correction lever 12 in dependence on the starting temperature and thus also changes the relative position of the control plunger 14 with respect to the pivotal lever 11 of the air sensor 3. When the engine temperatures are above approximately 20° C., the bimetallic spring 53 is bent so far away from the control plunger as to make contact with the wall portion 63 of the opening 57 in the lever 11. In order to begin reducing the starting fuel quantity at the moment of initiation of engine starting, the bimetallic spring 53 is provided with an electrical heating element 59 which is energized by the ignition switch 60 and the starting switch 61. The heat provided by the heater element 59 tends to bend the bimetallic spring 53 such as to diminish the fuel quantity provided by the control plunger 14. The bimetallic spring 53 is provided with a second holding heater 62 which is energized by the ignition switch 60 and whose purpose it is to hold the bimetallic spring 53 against the wall portion 63 of the opening 57 in the lever 11 after the starting process has terminated. The dimensions of the holding heater 62 are such that it heats up substantially more slowly than the primary heating element 59. Both heater elements 59, 62 can be heating coils, PTC resistors (as shown in FIG. 3), or the like.

In an exemplary embodiment which is not illustrated, the bimetallic spring 53 could be rigidly connected at its end 54 with the housing of the air flow sensor 3 while the free end 56 would engage the control plunger 14 directly at the pivotal lever 11 so as to obtain a starting fuel quantity.

Figure 2:
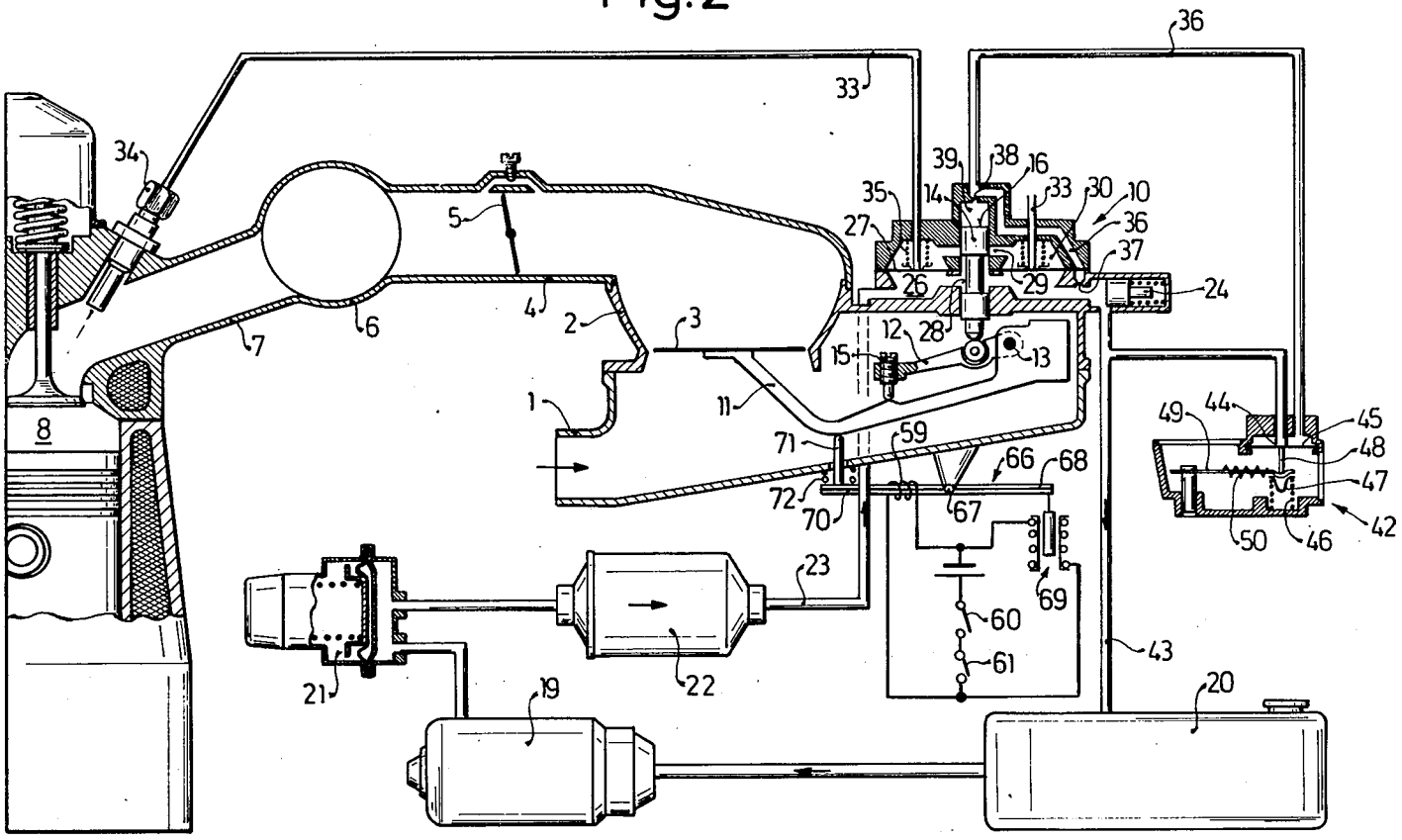
FIG. 2 is a second exemplary embodiment of the fuel injection system according to the invention including cold starting control.

A second exemplary embodiment of the invention is illustrated in FIG. 2, wherein identical parts have the same reference numerals as in FIG. 1. FIG. 2 illustrates a bimetallic spring 66 which is embodied as a double lever which pivots about a fixed point 67 and whose lever arm 68 is engaged by a solenoid 69 while its arm 70 carries the electrical heating element 59. The starting solenoid 69 and the electrical starting heater 59 are both energized by the ignition switch 60 and the starting switch 61. When the starting solenoid 69 is energized, the lever arm 70 of the bimetallic spring 66 moves a pin 71 which engages the pivotal arm 11 of the air flow sensor and thus displaces the control plunger 14 of the fuel metering and distribution valve in a temperature-dependent manner in the direction of further opening. When the engine starting has terminated and the starter switch 61 is open, the electrical circuit of the solenoid 69 is interrupted and the bimetallic spring 66 disengages from the pivotal lever 11 of the air flow sensor 3. A spring 72 returns the bimetallic lever 66 to its original position.

The foregoing relates to preferred embodiments of the invention, it being understood that many variants and embodiments thereof are possible within the spirit and scope of the invention, the latter being defined by the appended claims.

What is claimed is:

1. In a fuel injection system for internal combustion engines with continuous intake manifold injection, including an air flow sensor and a throttle valve located seriatim in the intake manifold and also including a fuel metering and distributing mechanism with a control plunger actuated by said air flow sensor and further including means for applying a restoring force to said air flow sensor, the improvement comprising:

bimetallic means, coupled to said air flow sensor, for providing a temperature-dependent force to said control plunger to thereby increase the amount of fuel delivered when the engine starting temperature is below approximately 20° C., wherein said air flow sensor has a main lever and a correction lever pivotable thereon and wherein one end of said bimetallic means is attached to said main lever while the opposite end of said bimetallic means engages said correction lever which actuates said control slide in said fuel metering and distributing mechanism.

2. A fuel injection system as defined by claim 1, further comprising a secondary heating means attached to said bimetallic means.

3. A fuel injection system as defined by claim 2, wherein said primary and secondary heating means are heating coils.

4. A fuel injection system as defined by claim 3, wherein said heating means are PTC resistors.

5. A fuel injection system as defined in claim 1, further comprising:

primary heating means, attached to said bimetallic means, for heating the same and thereby decrease the force applied to said control plunger, said primary heating means being electrically energizable via the ignition switch and the starter switch of the engine.

6. A fuel injection system as defined by claim 5, further comprising second heating means attached to said bimetallic means, said second heating means being electrically energizable via the ignition switch of the engine and supplying substantially less heat to said bimetallic means than does said primary heating means.

* * * * *